US006916152B2

(12) United States Patent
Keener

(10) Patent No.: US 6,916,152 B2
(45) Date of Patent: Jul. 12, 2005

(54) CENTRIFUGAL SEWAGE PUMPS WITH TWO IMPELLERS

(76) Inventor: Robert M. Keener, 1186 State Rte. 511 North, Ashland, OH (US) 44805

( * ) Notice: Subject to any disclaimer, the term of this patent is extended or adjusted under 35 U.S.C. 154(b) by 95 days.

(21) Appl. No.: 10/461,810

(22) Filed: Jun. 13, 2003

(65) Prior Publication Data

US 2004/0253094 A1 Dec. 16, 2004

(51) Int. Cl.[7] ..... F01D 25/00
(52) U.S. Cl. ..... 415/121.1; 241/46.11
(58) Field of Search ..... 415/121.1; 241/46.11, 241/46.017, 101.2, 186.6; 418/48, 182

(56) References Cited

U.S. PATENT DOCUMENTS 3,558,012 A * 1/1971 Weis ..... 222/54
3,873,244 A * 3/1975 Jaggi ..... 417/423.6
4,378,093 A * 3/1983 Keener ..... 241/46.017
6,010,086 A 1/2000 Earle, III et al. ..... 241/46.11

* cited by examiner

*Primary Examiner*—Hoang Nguyen
(74) *Attorney, Agent, or Firm*—Donald J. Ersler

(57) ABSTRACT

A centrifugal sewage pump with two impellers includes a motor, a first impeller housing, a second impeller housing and a transfer tube. The first impeller housing is attached on one end of the motor and the second impeller housing is attached to the other end of the motor. A first impeller is attached to one end of a motor shaft of the motor and a second impeller is attached to the other motor shaft. Sewage is drawn into the first impeller chamber and pushed into the transfer tube with the first impeller. Sewage from the transfer tube enters the second impeller chamber through a transfer cavity and is pushed out with the second impeller. In a second embodiment, a grinder wheel and shredder ring are added to an inlet of the first impeller housing. A discharge head height is nearly twice that of a single impeller pump.

17 Claims, 7 Drawing Sheets

CENTRIFUGAL SEWAGE PUMPS WITH TWO IMPELLERS

BACKGROUND OF THE INVENTION

1. Field of the Invention

The present invention relates generally to centrifugal sewage pumps and more specifically to solids handling and grinder type centrifugal sewage pumps with two impellers that produce a discharge head, which is nearly twice as high as a single impeller centrifugal sewage pump.

2. Discussion of the Prior Art

The prior art does teach multi-staging of impellers with a discharge head that increases incrimentally by the number of impellers. However, the prior art pumps do not allow for large and stringy solids to freely flow from one stage to another without causing restrictions and loss of flow. The reason for the restrictions and loss of flow is the complex passages contained in the prior art pumps. The large and stringy solids become clogged in the complex passages.

Further, positive displacement, progressive cavity pumps do provide impressive discharge head. However, the positive displacement, progressive cavity pumps have high related maintenance, due to the wear of the rotor and stator and the close tolerance that must be maintained to deliver a high discharge head. The rotors and stators wear rapidly and thereby reduce the original tight tolerances that are required to deliver a high discharge head. Grinder pumps require a high discharge head to function correctly in pressure sewage systems, which is their primary application.

Accordingly, there is a clearly felt need in the art for centrifugal sewage pumps with two impellers, which do not have restrictive, complex passages for solid materials in sewage liquid to become clogged; do not require high maintenance; and which provide a discharge head height that is nearly twice that of a single impeller centrifugal pump, while drawing nearly the same amount of electrical power as a single impeller pump.

SUMMARY OF THE INVENTION

The present invention provides centrifugal sewage pumps with two impellers, which do not become clogged with solid waste. A centrifugal sewage pump with two impellers includes a motor housing, a first impeller housing, a second impeller housing and a transfer tube. The first impeller housing is attached to one end of the motor housing and the second impeller housing is attached to the other end of the motor housing. The transfer tube couples a first outlet of the first impeller housing to a second inlet of the second impeller housing. The first impeller housing includes a first inlet, the first outlet and a first impeller chamber. The second impeller housing includes a transfer cavity, the second inlet, a second outlet and a second impeller chamber. A motor with a shaft extending from both ends thereof is retained within the motor housing. A first impeller is attached to one end of the shaft and a second impeller is attached to the other end of the shaft.

The first impeller rotates within the first impeller chamber. Sewage is drawn into the first impeller chamber through the first inlet and is pushed out of the first impeller chamber through the first outlet with the first impeller. The second impeller rotates within the second impeller chamber. Sewage exits the first outlet through the transfer tube into a transfer inlet of the transfer cavity. Sewage is drawn into the second impeller chamber through the second inlet and pushed out of the second impeller chamber through the second outlet with the second impeller. The discharge head produced at the second outlet will be nearly twice the height of a single impeller centrifugal pump with nearly the same electrical power consumption.

The first impeller and first impeller chamber admit sewage having large and stringy solids mixed in with the liquid. The sewage is pumped into the second impeller chamber through the transfer tube without clogging. The sewage flowing through the second impeller chamber is limited to the flow through the first impeller chamber. The flow through the second impeller chamber nearly doubles the discharge head from the first impeller chamber.

In a second embodiment, the centrifugal sewage pump with two impellers is a centrifugal sewage grinder pump with two impellers. A grinder wheel and shredding ring are disposed in the first inlet. The grinder wheel is attached to an end of the first impeller and communicates with the shredder ring. The shredder ring is retained in the first impeller housing. The grinder wheel and shredder ring reduce the size of the large and stringy solids in the liquid for uninhibited flow through the first and second impeller chambers. The discharge head produced at a second outlet of the centrifugal sewage grinder pump will be nearly twice the height of a single impeller centrifugal grinder pump with nearly the same electrical power consumption.

Accordingly, it is an object of the present invention to provide a centrifugal sewage pump with two impellers, which does not have complex passages for solid materials in sewage liquid to become trapped.

It is a further object of the present invention to provide a centrifugal sewage pump with two impellers, which does not have high maintenance, because the impellers and impeller chambers are not in contact with each other as would be in a positive displacement, progressive cavity pump.

Finally, it is another object of the present invention to provide a centrifugal sewage pump with two impellers, which provides a discharge head height that is nearly twice that of a single impeller centrifugal pump, while drawing nearly the same amount of electrical power as a single impeller pump.

These and additional objects, advantages, features and benefits of the present invention will become apparent from the following specification.

DETAILED DESCRIPTION OF THE PREFERRED EMBODIMENTS

Figure 1:
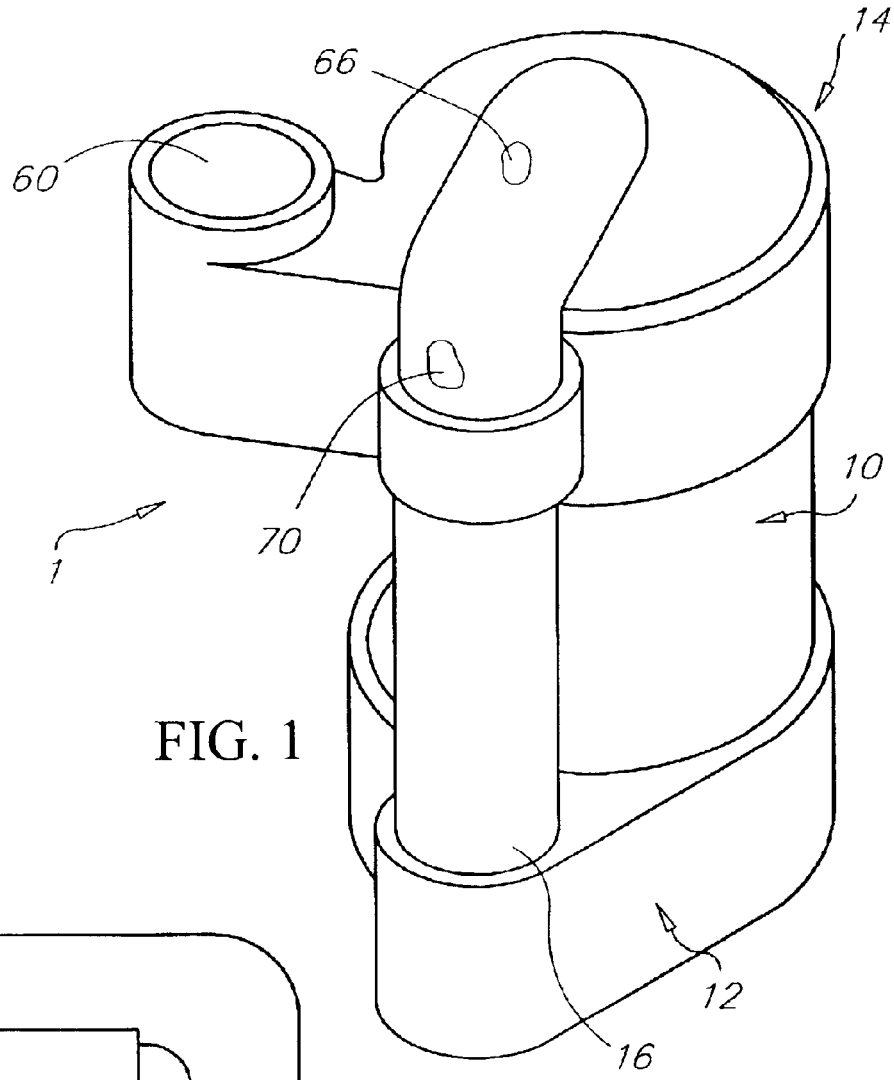
FIG. 1 is a perspective view of a centrifugal sewage pump with two impellers in accordance with the present invention.
Figure 2:
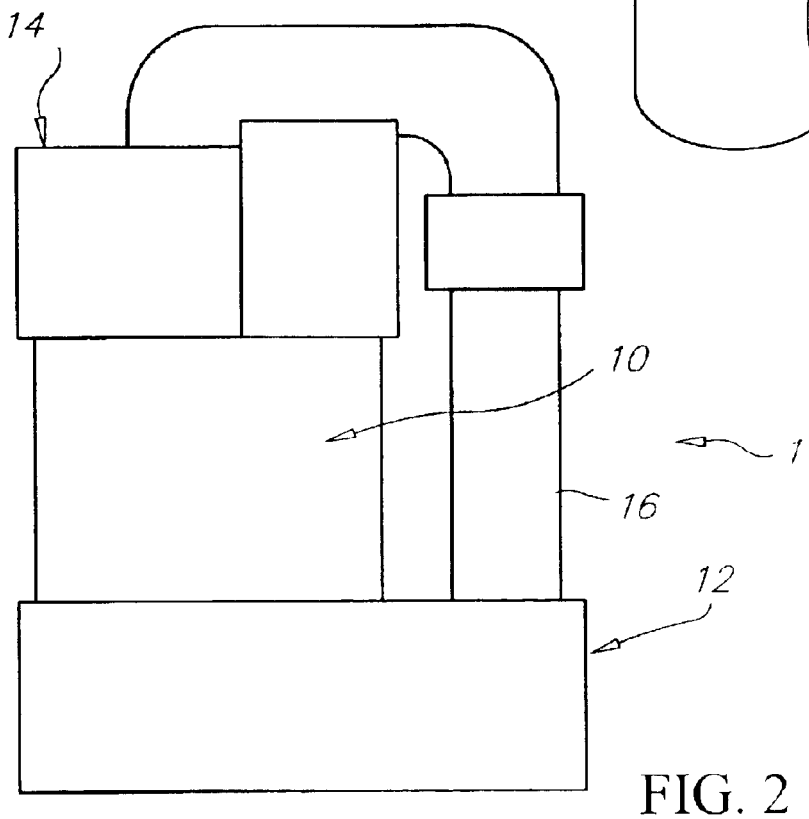
FIG. 2 is a front view of a centrifugal sewage pump with two impellers in accordance with the present invention.
Figure 3:
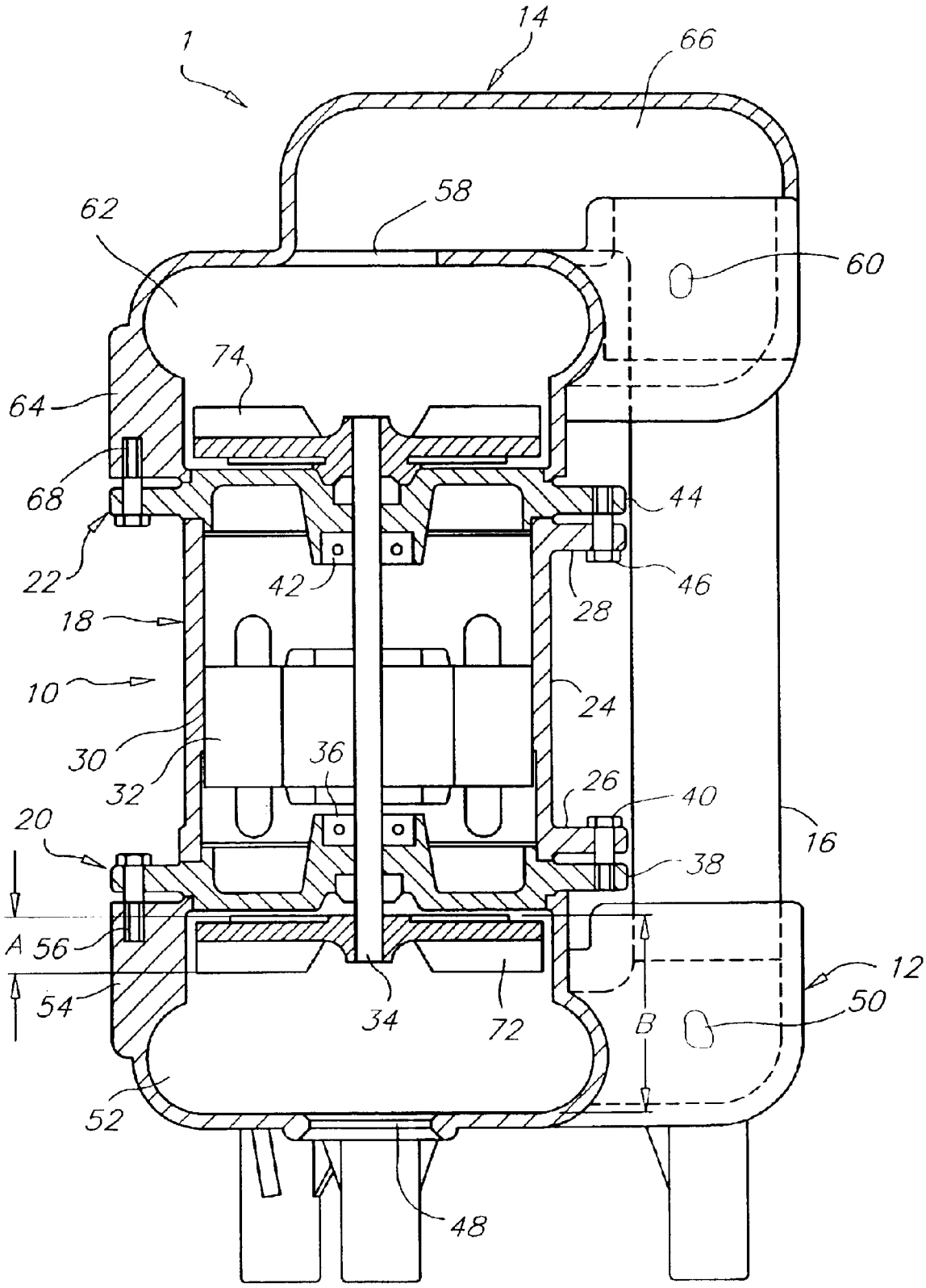
FIG. 3 is a cross sectional view of a centrifugal sewage pump with two impellers in accordance with the present invention.
Figure 4:
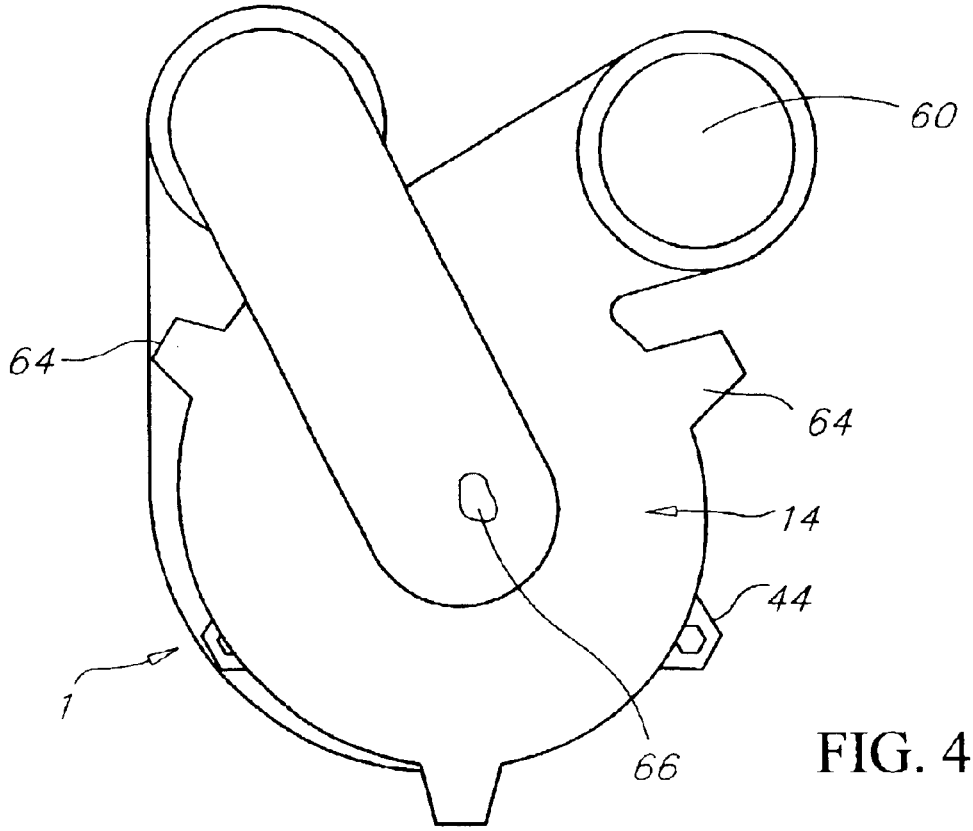
FIG. 4 is a top view of a centrifugal sewage pump with two impellers in accordance with the present invention.
Figure 5:
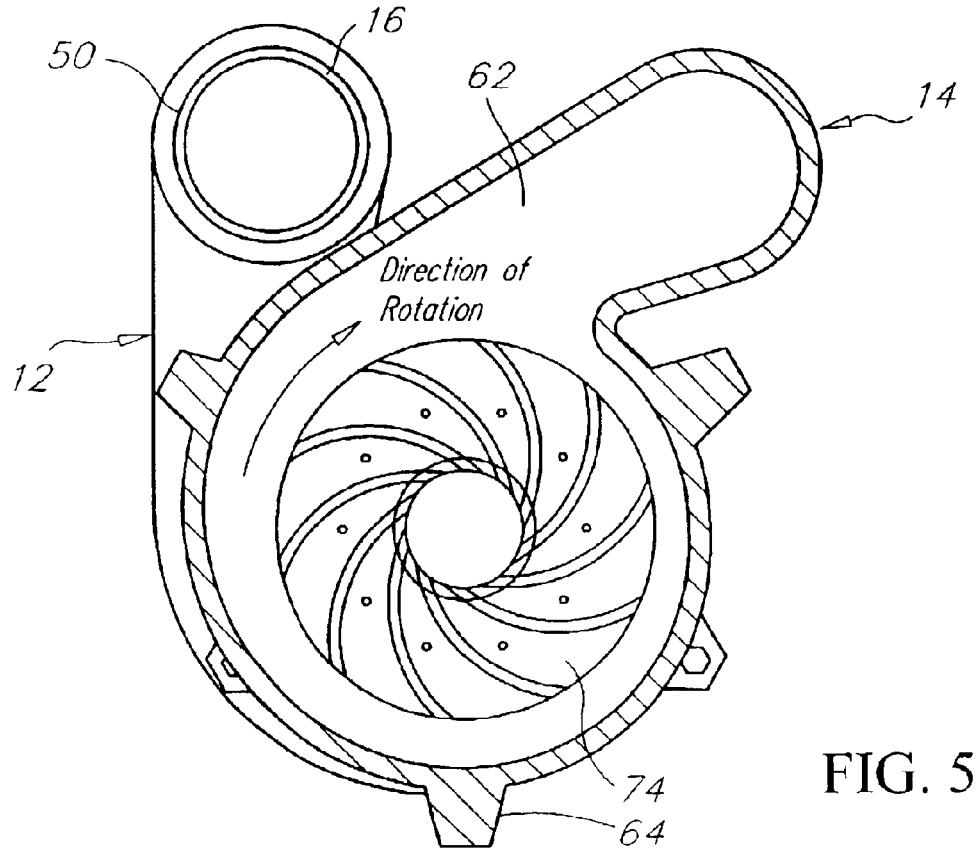
FIG. 5 is a top view of a centrifugal sewage pump with two impellers, revealing a second impeller chamber in accordance with the present invention.
Figure 6:
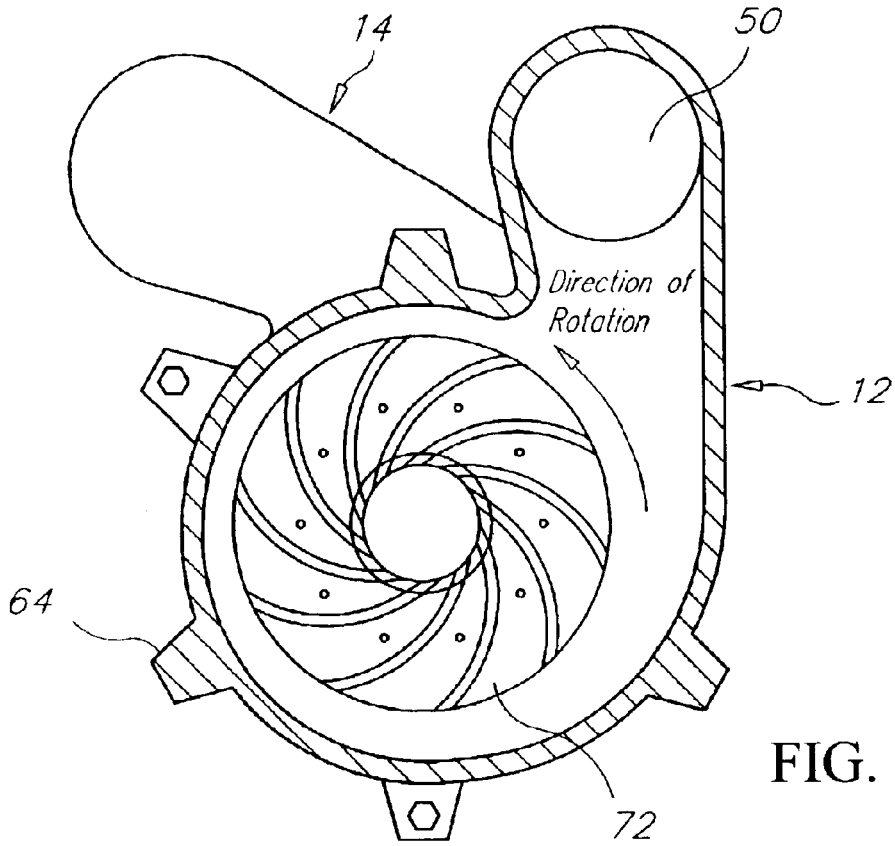
FIG. 6 is a bottom view of a centrifugal sewage pump with two impellers, revealing a first impeller chamber in accordance with the present invention.
Figure 12:
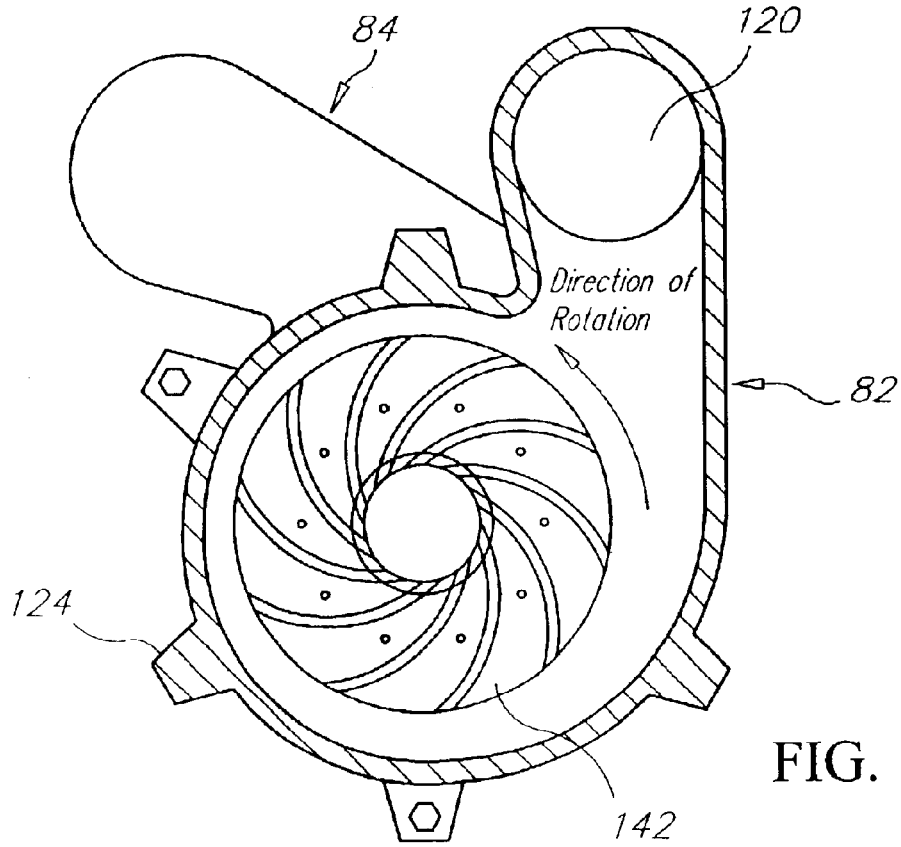
FIG. 12 is a bottom view of a centrifugal sewage grinder pump with two impellers, revealing a first impeller chamber in accordance with the present invention.
Figure 7:
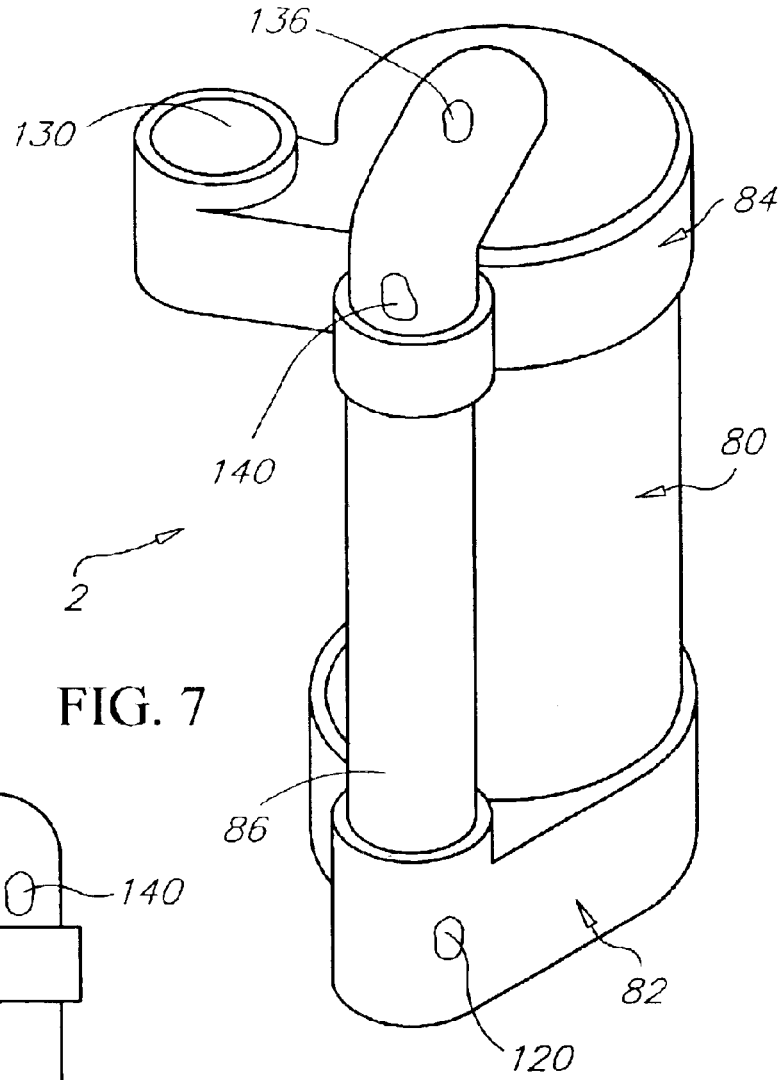
FIG. 7 is a perspective view of a centrifugal sewage grinder pump with two impellers in accordance with the present invention.
Figure 8:
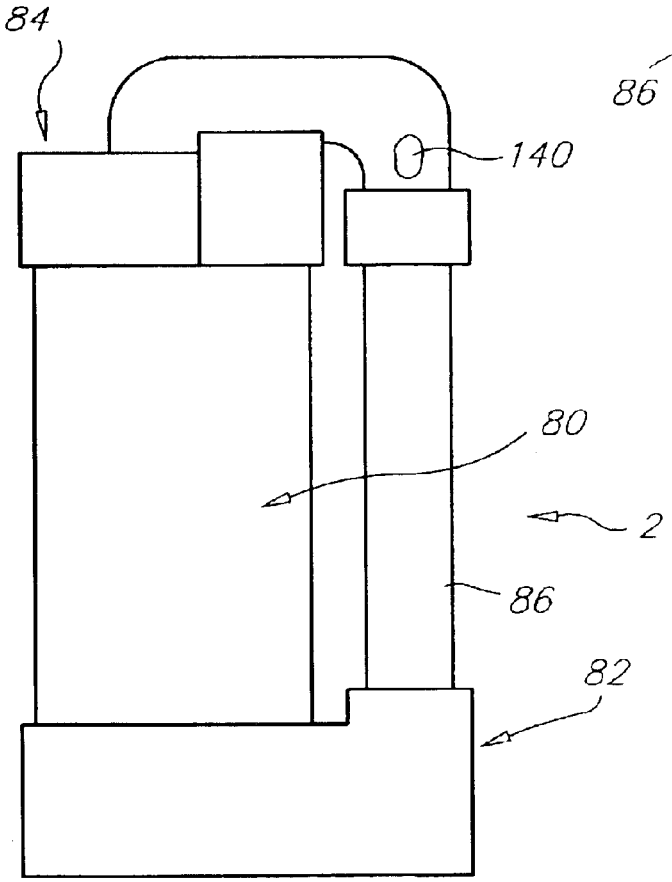
FIG. 8 is a front view of a centrifugal sewage grinder pump with two impellers in accordance with the present invention.
Figure 9:
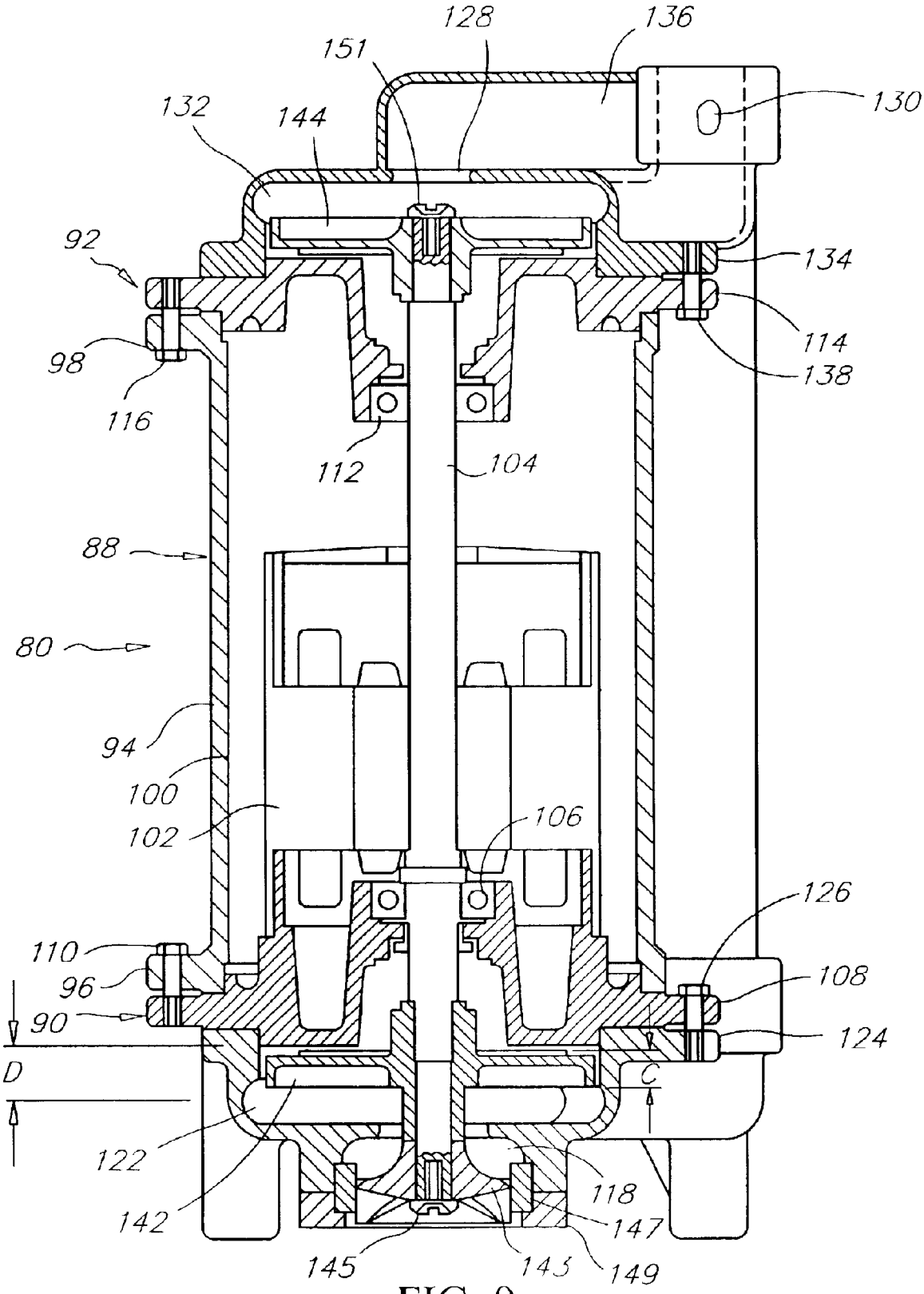
FIG. 9 is a cross sectional view of a centrifugal sewage grinder pump with two impellers in accordance with the present invention.
Figure 10:
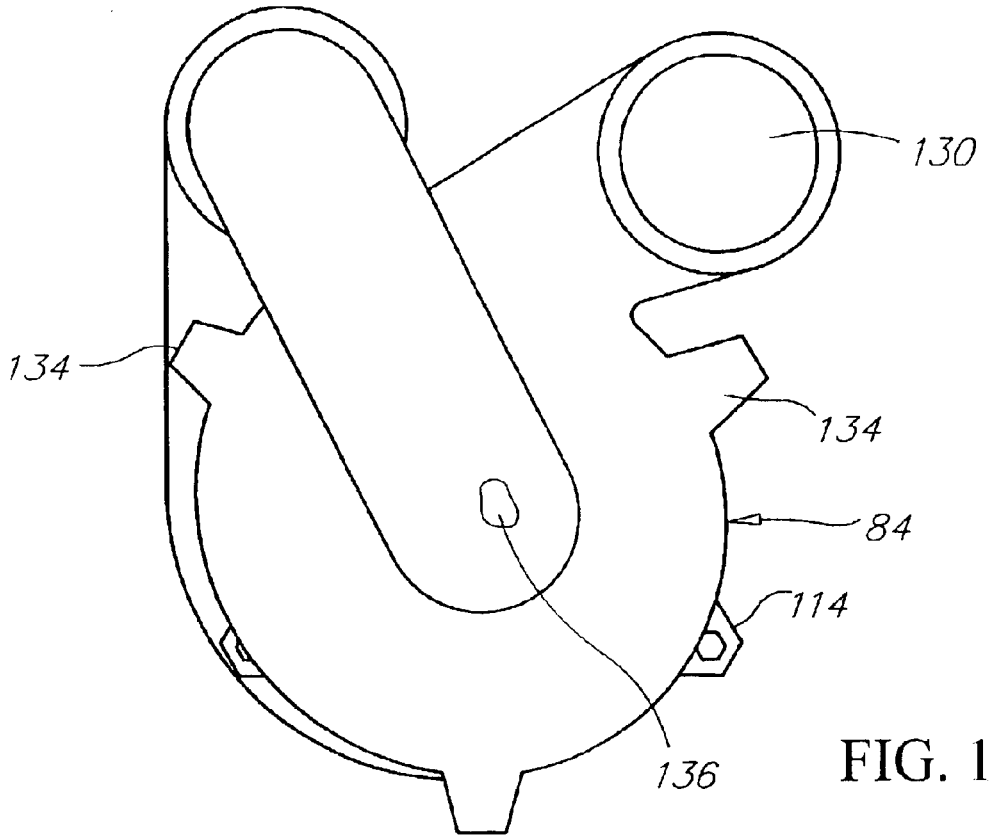
FIG. 10 is a top view of a centrifugal sewage grinder pump with two impellers in accordance with the present invention.
Figure 11:
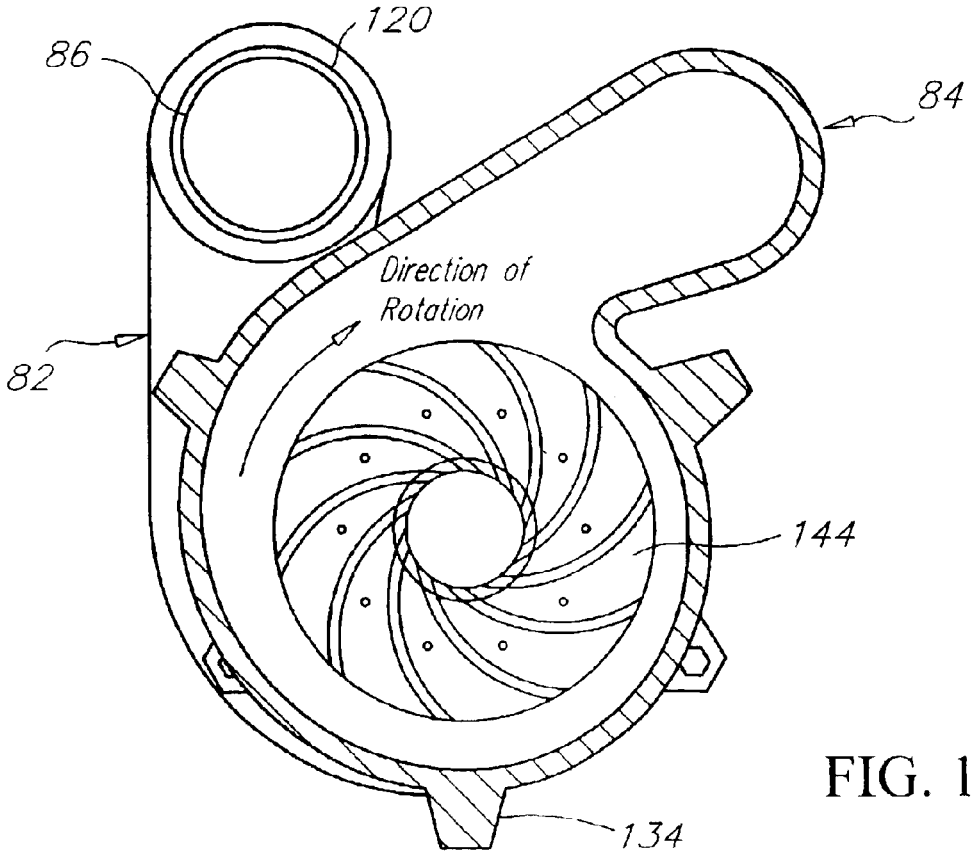
FIG. 11 is a top view of a centrifugal sewage grinder pump with two impellers, revealing a second impeller chamber in accordance with the present invention.

With reference now to the drawings, and particularly to FIG. 3, there is shown a perspective view of a centrifugal sewage pump with two impellers 1. With reference to FIGS. 1, 2 and 4-6, the centrifugal sewage pump with two impellers 1 includes a motor housing 10, a first impeller housing 12, a second impeller housing 14 and a transfer tube 16. The motor housing 10 includes a motor case 18, a first bearing plate 20 and a second bearing plate 22. The motor case 18 includes a tubular body 24 with at least three first flange member 26 extending from a first end thereof and at least three second flange members 28 extending from a second end thereof. An inside bore 30 of the motor case 18 is sized to firmly receive a motor 32. A shaft 34 extends from both ends of the motor 32.

A first shaft bearing 36 is pressed into a bearing bore in the first bearing plate 20. The first shaft bearing 36 is sized to receive one end of the shaft 34. At least six first plate flanges 38 extend outward from the first bearing plate 20. The first bearing plate 20 is attached to one end of the tubular body 24 by securing the at least three first flange members 26 to at least three first plate flanges 38 with at least three fasteners 40. A second shaft bearing 42 is pressed into a bearing bore in the second bearing plate 22. The second shaft bearing 42 is sized to receive the other end of the shaft 34. At least six second plate flanges 44 extend outward from the second bearing plate 22. The second bearing plate 22 is attached to the other end of the tubular body 24 by securing the at least three second flange members 28 to at least three second plate flanges 44 with at least three fasteners 46.

The first impeller housing 12 includes a first inlet 48, the first outlet 50, a first impeller chamber 52 and at least three first impeller flanges 54. The first impeller housing 12 is attached to one end of the motor housing 10 by securing at least three first plate flanges 38 to the at least three first impeller flanges 54 with at least three fasteners 56. The second impeller housing 12 includes a second inlet 58, the second outlet 60, a second impeller chamber 62, at least three second impeller flanges 64 and a transfer cavity 66. The second impeller housing 14 is attached to the other end of the motor housing 10 by securing at least three second plate flanges 44 to the at least three second impeller flanges 64 with at least three fasteners 68.

The transfer tube 16 is inserted into the first outlet 50 and into a transfer inlet 70 of the transfer cavity 66 to couple the first impeller chamber 52 with the second impeller chamber 62. A first impeller 72 is attached to one end of the shaft 34 and a second impeller 74 is attached to the other end of the shaft 34. Sewage is drawn into the first impeller chamber 52 through the first inlet 48 and pushed out of the first impeller chamber 52 through the first outlet 50 by rotation of the first impeller 72. Sewage exits the first outlet 50 through the transfer tube 16 into the transfer inlet 70. Sewage is drawn into the second impeller chamber 62 through the transfer cavity 66 and the second inlet 58. The sewage is pushed out of the second impeller chamber 62 through the second outlet 60 by rotation of the second impeller 74. The discharge head produced at the second outlet will be nearly twice the height of a single impeller centrifugal pump with nearly the same electrical power consumption. The first and second impeller chambers have a substantial volute shape.

The height of a vane of the first impeller 72 and the second impeller 74 are preferably equal to a dimension "A." The height of the first impeller chamber 52 and the second impeller chamber 62 are preferably equal to dimension "B." Where dimension "B" is at least three times greater than dimension "A."

In a second embodiment, the centrifugal sewage pump with two impellers is a centrifugal sewage grinder pump with two impellers 2. With reference to FIGS. 7–12, the centrifugal sewage grinder pump with two impellers 2 includes a motor housing 80, a first impeller housing 82, a second impeller housing 84 and a transfer tube 86. The motor housing 80 includes a motor case 88, a first bearing plate 90 and a second bearing plate 92. The motor case 88 includes a tubular body 94 with at least three first flange member 96 extending from a first end thereof and at least three second flange members 98 extending from a second end thereof. An inside bore 100 of the motor case 88 provides clearance for a motor 102. A shaft 104 extends from both ends of the motor 102.

A first shaft bearing 106 is pressed into a bearing bore in the first bearing plate 90. The first shaft bearing 106 is sized to receive one end of the shaft 104. At least six first plate flanges 108 extend outward from the first bearing plate 90. The first bearing plate 90 is attached to one end of the tubular body 104 by securing the at least three first flange members 96 to at least three first plate flanges 108 with at least three fasteners 110. One end of the motor 102 is secured to the first bearing plate 90 with any suitable attachment method, such as fasteners. A second shaft bearing 112 is pressed into a bearing bore in the second bearing plate 92. The second shaft bearing 112 is sized to receive the other end of the shaft 104. At least six second plate flanges 114 extend outward from the second bearing plate 92. The second bearing plate 92 is attached to the other end of the tubular body 104 by securing the at least three second flange members 98 to at least three second plate flanges 114 with at least three fasteners 116.

The first impeller housing 82 includes a first inlet 118, the first outlet 120, a first impeller chamber 122 and at least three first impeller flanges 124. The first impeller housing 82 is attached to one end of the motor housing 80 by securing at least three first plate flanges 108 to the at least three first impeller flanges 124 with at least three fasteners 126. The second impeller housing 82 includes a second inlet 128, the second outlet 130, a second impeller chamber 132, at least three second impeller flanges 134 and a transfer cavity 136. The second impeller housing 84 is attached to the other end of the motor housing 80 by securing at least three second plate flanges 114 to the at least three second impeller flanges 134 with at least three fasteners 138.

The transfer tube 36 is inserted into the first outlet 120 and into a transfer inlet 140 of the transfer cavity 138 to couple the first impeller chamber 122 with the second impeller chamber 132. A first impeller 142 and a grinder wheel 143 are attached to one end of the shaft 104 with a fastener 145. A shredding ring 147 is retained in the first inlet 118 with a retainer ring 149. The retainer ring 149 is secured to a bottom of the first impeller housing 82 with any suitable attachment method such as fasteners. The shredder ring 147 is sized to receive the grinder wheel 143. Any solid waste that enters the first inlet 118 must pass through the gap between the grinder wheel 143 and shredder ring 147.

A second impeller 144 is attached to the other end of the shaft 104 with a fastener 151. Sewage is drawn into the first impeller chamber 122 through the first inlet 118 and pushed out of the first impeller chamber 122 through the first outlet 120 by rotation of the first impeller 142. Sewage exits the first outlet 120 through the transfer tube 86 into the transfer inlet 140. Sewage is drawn into the second impeller chamber 132 through the transfer cavity 136 and the second inlet 128. The sewage is pushed out of the second impeller chamber 132 through the second outlet 130 by rotation of the second impeller 144. The discharge head produced at the second outlet 130 will be nearly twice the height of a single impeller centrifugal pump with nearly the same electrical power consumption. The first and second impeller chambers have a substantial volute shape.

The height of a vane of the first impeller 142 and the second impeller 144 are preferably equal to a dimension "C." The height of the first impeller chamber 122 and the second impeller chamber 132 are preferably equal to dimension "D." Where dimension "D" is at least twice dimension "C."

A vortex type of impeller is preferably used for the first impeller 72, 142 and second impeller 74, 144. A nonclog impeller may also be used. The impeller must allow solid waste to pass through the pump. The vortex or the nonclog are well suited for allowing stringy solids to pass through the pump. The vortex and nonclog impellers are well known in the art and need not be explained in detail.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of providing a discharge head height that is nearly twice that of a single impeller centrifugal sewage pump, while drawing nearly the same amount of electrical power as a single impeller pump, comprising the steps of:

drawing sewage into a first impeller chamber with a first centrifugal induced flow impeller, said first centrifugal induced flow impeller having downward facing vanes, the sewage including solid waste, pushing the sewage out of said first impeller chamber with said first centrifugal induced flow impeller, said first impeller chamber having a substantially volute shape;

pushing the sewage into a second impeller chamber with a second centrifugal induced flow impeller, pushing the sewage out of said second impeller chamber with said second centrifugal induced flow impeller, said second impeller chamber having a substantially volute shape; and providing a motor for rotating said first centrifugal induced flow impeller and said second centrifugal induced flow impeller, said motor being rotated with electrical power.

2. The method of providing a discharge head height that is nearly twice that of a single impeller centrifugal sewage pump, while drawing nearly the same amount of electrical power as a single impeller pump of claim 1, further comprising the steps of:

providing said first impeller chamber with a height that is at least twice the height of a vane of said first centrifugal induced flow impeller; and providing said second impeller chamber with a height that is at least twice the height of a vane of said second centrifugal induced flow impeller.

3. The method of providing a discharge head height that is nearly twice that of a single impeller centrifugal sewage pump, while drawing nearly the same amount of electrical power as a single impeller pump of claim 1, further comprising the step of:

providing a vortex type of impeller for said first and second centrifugal induced flow impellers.

4. The method of providing a discharge head height that is nearly twice that of a single impeller centrifugal sewage pump, while drawing nearly the same amount of electrical power as a single impeller pump of claim 1, further comprising the step of:

providing a nonclog impeller for said first and second centrifugal induced flow impellers.

5. The method of providing a discharge head height that is nearly twice that of a single impeller centrifugal sewage pump, while drawing nearly the same amount of electrical power as a single impeller pump of claim 1, further comprising the step of:

providing said motor with a shaft extending from each end thereof, attaching said first centrifugal induced flow impeller to one end of said shaft and attaching said second centrifugal induced flow impeller to the other end of said shaft.

6. The method of providing a discharge head height that is nearly twice that of a single impeller centrifugal sewage pump, while drawing nearly the same amount of electrical power as a single impeller pump of claim 5, further comprising the step of:

attaching a grinder wheel to one end of said shaft, retaining a shredding ring that is sized to receive said grinder wheel.

7. The method of providing a discharge head height that is nearly twice that of a single impeller centrifugal sewage pump, while drawing nearly the same amount of electrical power as a single impeller pump of claim 1, further comprising the step of:

coupling said first impeller chamber to said second impeller chamber with a transfer tube.

8. A method of providing a discharge head height that is nearly twice that of a single impeller centrifugal sewage pump, while drawing nearly the same amount of electrical power as a single impeller pump, comprising the steps of:

drawing sewage into a first impeller chamber with a first centrifugal induced flow impeller, said first centrifugal induced flow impeller having downward facing vanes, the sewage including solid waste, pushing the sewage out of said first impeller chamber with said first centrifugal induced flow impeller, said first impeller chamber having a substantially volute shape, said first impeller chamber having a height that is at least three times the height of one of said downward facing vanes of said first impeller;

pushing the sewage into a second impeller chamber with a second centrifugal induced flow impeller, pushing the sewage out of said second impeller chamber with said second centrifugal induced flow impeller, said second impeller chamber having a substantially volute shape, said second impeller chamber having a height that is at least three times the height of a vane of said second centrifugal induced flow impeller; and providing a motor for rotating said first centrifugal induced flow impeller and said second centrifugal induced flow impeller, said motor being rotated with electrical power.

9. The method of providing a discharge head height that is nearly twice that of a single impeller centrifugal sewage pump, while drawing nearly the same amount of electrical power as a single impeller pump of claim 8, further comprising the step of:

providing a vortex type of impeller for said first and second centrifugal induced flow impellers.

10. The method of providing a discharge head height that is neatly twice that of a single impeller centrifugal sewage pump, while drawing nearly the same amount of electrical power as a single impeller pump of claim 8, further comprising the step of:

providing a nonclog impeller for said first and second centrifugal induced flow impellers.

11. The method of providing a discharge head height that is nearly twice that of a single impeller centrifugal sewage pump, while drawing nearly the same amount of electrical power as a single impeller pump of claim 8, further comprising the step of:

providing said motor with a shaft extending from each end thereof, attaching said first centrifugal induced flow impeller to one end of said shaft and attaching said second centrifugal induced flow impeller to the other end of said shaft.

12. The method of providing a discharge head height that is nearly twice that of a single impeller centrifugal sewage pump, while drawing nearly the same amount of electrical power as a single impeller pump of claim 8, further comprising the step of:

coupling said first impeller chamber to said second impeller chamber with a transfer tube.

13. A method of providing a discharge head height that is nearly twice that of a single impeller centrifugal sewage pump, while drawing nearly the same amount of electrical power as a single impeller pump, comprising the steps of:

drawing sewage into a first impeller chamber with a first centrifugal induced flow impeller, said first centrifugal induced flow impeller having downward facing vanes, the sewage including solid waste, pushing the sewage out of said first impeller chamber with said first centrifugal induced flow impeller, said first impeller chamber having a substantially volute shape, said first impeller chamber having a height that is at least twice the height of one said downward facing vanes of said first impeller;

rotating a grinder wheel at an inlet of said first impeller chamber, a shredder ring being sized to receive said grinder wheel;

pushing the sewage into a second impeller chamber with a second centrifugal induced flow impeller, pushing the sewage out of said second impeller chamber with said second centrifugal induced flow impeller, said second impeller chamber having a substantially volute shape, said second impeller chamber having a height that is at least twice the height of a vane of said second centrifugal induced flow impeller; and providing a motor for rotating said first centrifugal induced flow impeller, said second centrifugal induced flow impeller and said grinder wheel, said motor being rotated with electrical power.

14. The method of providing a discharge head height that is nearly twice that of a single impeller centrifugal sewage pump, while drawing nearly the same amount of electrical power as a single impeller pump of claim 13, further comprising the step of:

providing a vortex type of impeller for said first and second centrifugal induced flow impellers.

15. The method of providing a discharge head height that is nearly twice that of a single impeller centrifugal sewage pump, while drawing nearly the same amount of electrical power as a single impeller pump of claim 13, further comprising the step of:

providing a nonclog impeller for said first and second centrifugal induced flow impellers.

16. The method of providing a discharge head height that is nearly twice that of a single impeller centrifugal sewage pump, while drawing nearly the same amount of electrical power as a single impeller pump of claim 13, further comprising the steps of:

providing said motor with a shaft extending from each end thereof, attaching said first centrifugal induced flow impeller and said grinder wheel to one end of said shaft; and attaching said second centrifugal induced flow impeller to the other end of said shaft.

17. The method of providing a discharge head height that is nearly twice that of a single impeller centrifugal sewage pump, while drawing nearly the same amount of electrical power as a single impeller pump of claim 13, further comprising the step of:

coupling said first impeller chamber to said second impeller chamber with a transfer tube.

* * * * *